United States Patent [19]

Becker

[11] Patent Number: 4,643,747

[45] Date of Patent: Feb. 17, 1987

[54] REACTION GAS COOLER FOR LOW-ENERGY PLANTS

[75] Inventor: Jörgen Becker, Gummersbach, Fed. Rep. of Germany

[73] Assignee: L. & C. Steinmüller GmbH, Gummersbach, Fed. Rep. of Germany

[21] Appl. No.: 762,703

[22] Filed: Aug. 5, 1985

[30] Foreign Application Priority Data

Aug. 9, 1984 [DE] Fed. Rep. of Germany ..... 3429366

[51] Int. Cl.[4] ..... B01D 53/26

[52] U.S. Cl. ..... 55/269; 122/492; 165/145

[58] Field of Search ..... 55/269, DIG. 23, 342; 122/34, 398, 367 R, 488, 489, 492; 165/143, 145

[56] References Cited

U.S. PATENT DOCUMENTS

| | | | |
|---|---|---|---|
| 1,640,746 | 8/1927 | Braun | 165/143 |
| 3,463,125 | 8/1969 | Voorheis | 122/492 |
| 4,074,660 | 2/1978 | Tsao | 122/34 X |
| 4,156,457 | 5/1979 | Murray | 165/143 |
| 4,206,802 | 1/1980 | Reed et al. | 165/145 X |
| 4,242,110 | 12/1980 | Hynes | 55/269 |
| 4,309,196 | 1/1982 | Vollhardt et al. | 55/269 X |

OTHER PUBLICATIONS

International Patent Application, WO82/02583, 8--5-82.

*Primary Examiner*—Charles Hart

*Attorney, Agent, or Firm*—Becker & Becker, Inc.

[57] ABSTRACT

A reaction gas cooler, including a refractory lined gas inlet, a first stage in the form of a tube bundle heat exchanger through which gas flows, an intermediate chamber, and a second stage in the form of a tube bundle heat exchanger through which gas flows. The second stage has a double flow design, which is effected by a central pipe which is disposed in the intermediate chamber and divides the second stage into an in-flow zone and a reverse-flow zone.

7 Claims, 3 Drawing Figures

REACTION GAS COOLER FOR LOW-ENERGY PLANTS

BACKGROUND OF THE INVENTION

1. Field of the Invention

The present invention relates to a reaction gas cooler, which is primarily used for low-energy plants, for example in ammonia-producing plants. The reaction gas cooler includes a refractory lined gas inlet, a first stage in the form of a tube bundle heat exchanger through which the gas flows, an intermediate chamber, and a second stage in the form of a tube bundle heat exchanger through which the gas flows.

2. Description of the Prior Art

With such low-energy plants, the heat of the reaction gas is to be utilized to the greatest extent possible for producing saturated steam or vapor.

In order to take advantage of the sensible or perceptible heat of the reaction gas in previously existing plants, it was generally necessary to utilize, among other things, a feed-water heater. In low-energy plants, for reasons of overall heat balance, the feed-water heater must be replaced by a second evaporation stage. However, in so doing the following problems arise: For heat-transfer reasons, the length of the heretofore known cooler is limited to approximately 6 m, since only extremely thin tube sheets or plates can be used which, if the cooler has any greater length, would bend due to their elasticity. However, for an optimum gas inlet velocity, in nearly all cases, design computations result in greater overall structural lengths for the cooler. Thus, in order to achieve the theoretical heat transfer surface, the only possibility remaining was to increase the number of tubes. However, this reduces the velocity of the gas, the consequence of which is a poorer $\alpha$—value. Thus, it is inefficient to increase the heat transfer surface. Another problem is the by-pass tubes, which are necessary in order to keep the exit temperature constant. For this purpose, cooled gas must be mixed with hot gas, possibly accompanied by continuous readjustment.

An object of the present invention is to provide a reaction gas cooler which, without increasing the overall length, makes it possible to have an optimum gas inlet velocity in each stage, and with which the by-pass tubes for keeping the exit temperature constant can be eliminated.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
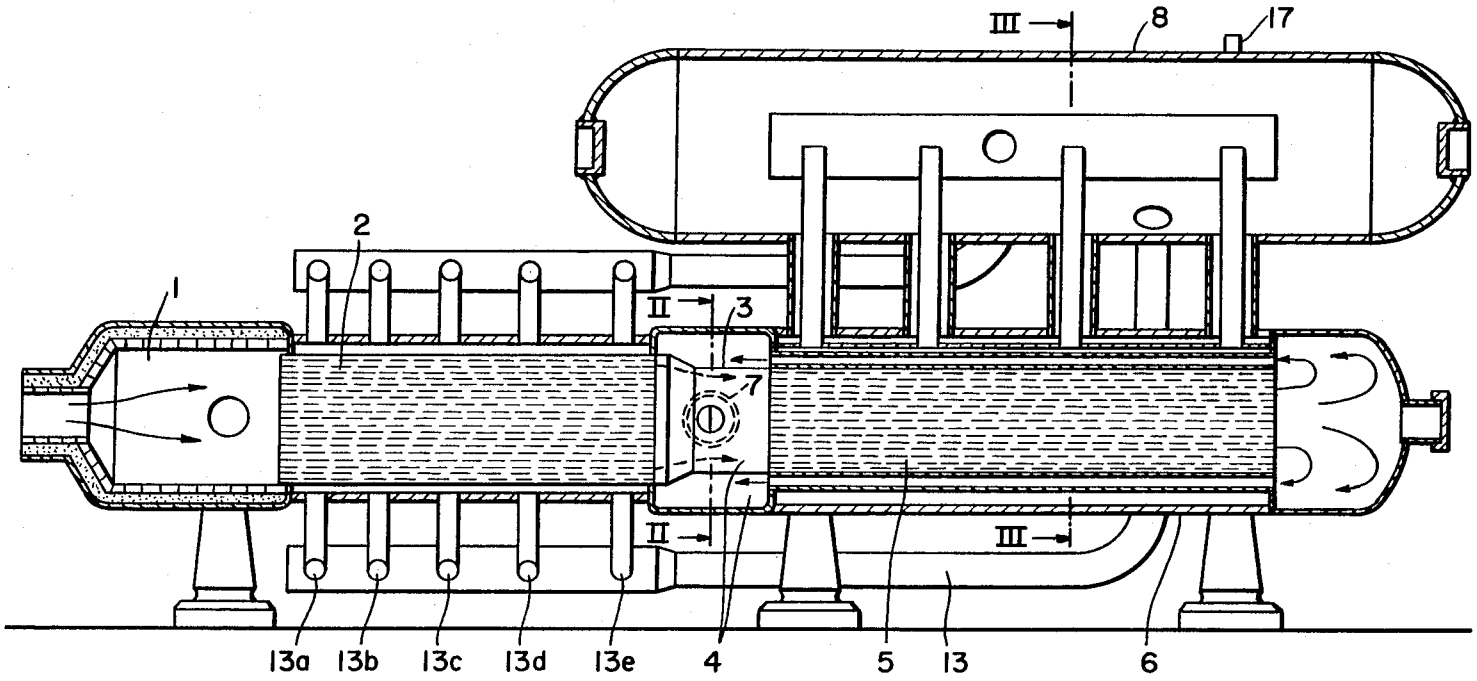
FIG. 1 is a view showing a longitudinal section through one inventive embodiment of a reaction gas cooler on which a drum has been placed.

The reaction gas cooler of the present invention is characterized primarily in that the second stage of a known reaction gas cooler inventively has a double flow design, so that for all practical purposes a three-stage cooler is provided.

This two-stage design is inventively achieved by providing the second stage with an in-flow zone in the form of a centrally disposed tube bundle, while the reverse-flow zone of the gas, the direction of which is reversed at the end of the second stage, is located in the annular space between the wall of the container and the central in-flow zone. In the in-flow and reverse-flow zones, the heat exchange elements are preferably embodied as tube bundles about which the coolant flows.

Pursuant to a preferred embodiment of the present invention, a drum is disposed upon the second stage and is connected with the latter via double pipes. These double pipes between the drum and the second stage are embodied in such a way that the central pipe is designed as a riser, and the annular space between the outer pipe and the central pipe is designed as a down pipe. The cooling water flows out of the drum and through the down pipes transverse to the heat exchange tubes, while steam and hot water rise upwardly through the risers. By means of a jacket, e.g. a steel jacket, which is disposed about the heat exchanger tubes, the water is conveyed out of the down pipes to the deepest location of the heat exchanger.

Disposed within the drum is a sheet-metal box into which open not only the risers from the second stage, but also the riser from the first stage. Cyclones are disposed at both ends of the sheet-metal box in order to separate vapor (steam) and liquid.

Supply of cooling water to the first stage is effected via an outlet disposed near the bottom of the drum, and via a pipe, from which extend branch pipes which, as was the case in the second stage, allow the coolant to flow transverse to the heat exchanger tubes. In this connection, the number and arrangement of the down pipes and risers are preferably determined in conformity with and according to the anticipated heat-flux density.

The inventive apparatus permits the heat transfer surface to be optimized. In addition to the elimination of the by-pass tubes or pipes, a further advantage is that the refractory lining of the intermediate chamber required with the heretofore known two-stage reaction gas coolers can be eliminated because now the walls of this intermediate chamber are cooled by the gas which is flowing back in the space between the container wall and the central pipe, and which is already considerably cooled off. The cooled gas is then withdrawn at the periphery of the intermediate chamber.

DESCRIPTION OF PREFERRED EMBODIMENTS

Referring now to the drawings in detail, the hot reaction gas, for example at a temperature of 1000° C., flows through the refractory line gas inlet 1, through the heat exchanger tubes of the first stage 2, through the inner sheet-metal channel 3 of the intermediate chamber 4, and into the central region of the second stage 5. The direction of the gas is reversed at the end of the second stage, and the gas flows back into the intermediate chamber 4 through tubular elements which are disposed in the annular space between the central region of the second stage 5 and the wall of the pressure tank 6. When the gas enters the second stage, it has a temperature of, for example 600° C., and when the gas leaves the reverse-flow zone via the gas outlet 7 on the periphery of the intermediate chamber 4, it has a temperature of, for example, 350° C.

Figure 3:
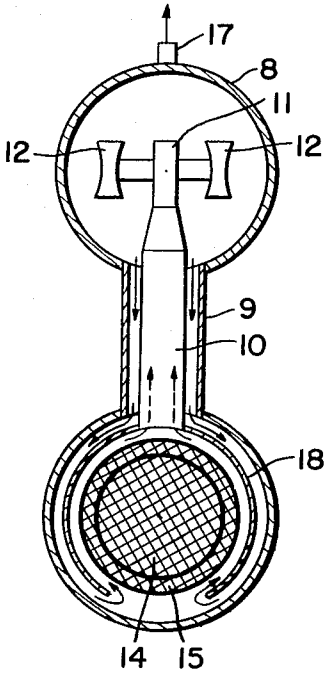
FIG. 3 is a view showing a section through the second stage and the drum, and is taken along the line III—III in FIG. 1.

As shown in FIG. 3, the drum 8 is rigidly connected via double pipes 9, 10 with one of the stages of the two-stage cooler, preferably with the second stage thereof. In addition to conveying water and steam, the pressure-stressed down pipes 9 also serve to support the drum upon the cooler. The central pipes 10 of the double pipes, which connect the drum and the cooler, open into a sheet-metal box 11, both ends of which are provided with cyclones 12 for separating steam bubbles and water. The riser of the first stage also opens into the drum, particularly into the interior of the sheet-metal box 11, at approximately the same level as do the risers of the second stage. The supply of cooling water to the first stage is effected via an outlet provided near the bottom of the drum, and via a pipe 13 which is divided into branch pipes 13*a*, 13*b*, 13*c*, 13*d*, and 13*e*.

Figure 2:
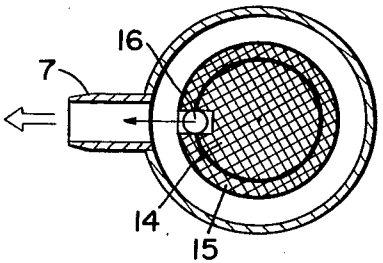
FIG. 2 is a view showing a section taken along the line II—II in FIG. 1.

FIG. 2 shows the central in-flow zone 14, and the reverse-flow zone 15. A by-pass 16 is provided for mixing cold and warm gases.

The sectional view of FIG. 3 is taken through the second cooler stage and the drum. A steam/water mixture rises in the central riser 10. Steam and water are separated in the cyclones 12. The steam exits through a steam outlet 17. In the annular space between the central pipe 10 and the outer pipe 9, the cooling water is first conveyed, via a steel jacket 18, to the deepest point of the cooler, and then flows around the heat exchanger tubes from the bottom toward the top.

By way of example only, in the illustrated embodiment, the first stage 2 may have a length of 4.1 m, the second stage may have a length of 5.7 m, and the overall length of the apparatus may be 16.4 m.

The present invention is, of course, in no way restricted to the specific disclosure of the specification and drawings, but also encompasses any modifications within the scope of the appended claims.

What I claim is:

1. A reaction gas cooler primarily for low-energy plants, for example in an ammonia-producing plant, with which heat of the reaction gas is utilized to greater extent possible for producing saturated steam or vapor, which includes, successively arranged, a refractory lined gas inlet, a first stage in the form of a tube bundle heat exchanger through which the gas flows, an intermediate chamber having a periphery, and a second stage in the form of a tube heat exchanger through which the gas flows;

the improvement wherein said second stage has a double flow design, so that for all practical purposes a three-stage cooler is provided, to permit heat transfer surface to be optimized in addition to elimination of by-pass tubes as well as elimination of refractory lining of the intermediate chamber because cooled gas flows back and is withdrawn at the periphery of the intermediate chamber.

2. A reaction gas cooler according to claim 1, in which said intermediate chamber is provided with a central pipe which extends into said second stage in such a way as to divide the latter into an in-flow zone and a reverse-flow zone, thus effecting said double flow design of said second stage.

3. A reaction gas cooler, which includes, successively arranged, a refractory lined gas inlet, a first stage in the form of a tube bundle heat exchanger through which the gas flows, an intermediate chamber, and a second stage in the form of a tube bundle heat exchanger through which the gas flows;

the improvement wherein said second stage has a double flow design;

a drum disposed on said second stage; which includes at least one double pipe arrangement which interconnects said drum and said second stage, each double pipe arrangement including an outer pipe, an inner central pipe, and an annular space between pipes, with said central pipe serving as a riser, and said annular space serving as a down pipe; and which includes further riser means and down pipe means in the form of pipes for connecting said drum with said first stage.

4. A reaction gas cooler according to claim 3, which includes a sheet-metal box disposed within said drum, with said central riser pipes of said second stage, and said riser pipe means of said first stage, opening into the interior of said sheet-metal box.

5. A reaction gas cooler according to claim 4, in which said sheet-metal box has two ends, each of which is provided with cyclone means for separating steam and water.

6. A reaction gas cooler according to claim 3, in which said cooler is pressure-tight.

7. A reaction gas cooler primarily for low-energy plants, for example in an ammonia-producing plant, with which heat of the reaction gas is utilized to greatest extent possible for producing saturated steam or vapor, which includes, successively arranged, a refractory lined gas inlet, a first stage in the form of a tube bundle heat exchanger through which the gas flows, an intermediate chamber, and a second stage in the form of a tube bundle heat exhanger through which the gas flows;

the improvement wherein said second stage has a double flow design, so that for all practical purposes a three stage cooler is provided, and said second stage includes an in-flow zone and a reverse-flow zone, said in-flow and reverse-flow zones having heat exchange elements embodied as tube bundles about which coolant flows.

* * * * *